US007086511B2

(12) United States Patent
Morszeck et al.

(10) Patent No.: US 7,086,511 B2
(45) Date of Patent: Aug. 8, 2006

(54) SUITCASE, ESPECIALLY A PILOT SUITCASE

(75) Inventors: Dieter Morszeck, Cologne (DE); Martin Radtke, Iserlohn (DE)

(73) Assignee: Rimowa Kofferfabrik GmbH, Cologne (DE)

( * ) Notice: Subject to any disclaimer, the term of this patent is extended or adjusted under 35 U.S.C. 154(b) by 0 days.

(21) Appl. No.: 10/484,248

(22) PCT Filed: Jul. 17, 2002

(86) PCT No.: PCT/EP01/08213

§ 371 (c)(1),
(2), (4) Date: Aug. 17, 2004

(87) PCT Pub. No.: WO03/007748

PCT Pub. Date: Jan. 30, 2003

(65) Prior Publication Data

US 2005/0000964 A1 Jan. 6, 2005

(51) Int. Cl.
*A45C 13/04* (2006.01)

(52) U.S. Cl. ..... 190/122; 190/114; 150/126

(58) Field of Classification Search ..... 190/113, 190/122, 114; 150/127, 130, 121, 122, 123, 150/124, 126

See application file for complete search history.

(56) References Cited

U.S. PATENT DOCUMENTS

| | | | | | |
|---|---|---|---|---|---|
| 730,171 | A | * | 6/1903 | Smithline | 150/121 |
| 909,815 | A | * | 1/1909 | O'brien | 190/122 |
| 1,414,845 | A | * | 5/1922 | Wallenstein | 453/49 |
| 1,625,439 | A | * | 4/1927 | Walinsky | 190/122 |
| 1,779,159 | A | * | 10/1930 | Coe | 220/252 |
| 2,020,470 | A | * | 11/1935 | Landis | 428/102 |
| 2,054,936 | A | * | 9/1936 | Hiering | 150/122 |
| 2,327,532 | A | * | 8/1943 | Krupp | 150/110 |
| 2,371,318 | A | * | 3/1945 | Rosenfeld | 150/127 |
| 2,393,281 | A | * | 1/1946 | Berkowitz | 428/52 |
| 2,555,705 | A | * | 6/1951 | Schafer | 220/348 |
| 5,495,967 | A | * | 3/1996 | Parton | 224/610 |

FOREIGN PATENT DOCUMENTS

| | | | |
|---|---|---|---|
| FR | 697074 | * | 6/1930 |
| FR | 1099051 | * | 2/1954 |

* cited by examiner

*Primary Examiner*—Tri M. Mai
(74) *Attorney, Agent, or Firm*—Diller, Ramik & Wight

(57) ABSTRACT

In a case, in particular a pilot case, comprising a bottom element (2), a cover element (4) and side as well as front wall elements (6,8), the cover element (4) is made up of a plurality of hingedly interconnected strips (10).

27 Claims, 6 Drawing Sheets

SUITCASE, ESPECIALLY A PILOT SUITCASE

BACKGROUND OF THE INVENTION

The invention relates to a case, in particular a pilot case.

Such cases having a bottom element, side and front wall elements and a cover element made from a plurality of hingedly interconnected strips are known from FR 1.109.515.

For pilot cases one-hand operation for opening and closing the case is desired. It is a drawback of known pilot cases that one-hand operation is either impossible or very troublesome, and that the open cover requires too much space. Further, the raised cover element may cause the case to topple over if the case is not sufficiently weight-loaded.

It is therefore an object of the invention to provide a case, in particular a pilot case, which allows one-hand operation, can be opened without requiring too much space and is stable to a large extent.

SUMMARY OF THE INVENTION

According to the invention, the cover element is advantageously of bipartite configuration such that, in the closed position, both cover parts abut on each other and, in the open position, extend in parallel to the respective front wall elements on both sides of the case.

The two cover parts of the bipartite cover are coupled to each other via a linkage to allow synchronous movement of both cover parts. In this manner, a cover part provided with a handle can, for example, be moved, wherein the other cover part is moved either without a second hand being required for this operation.

Such a cover part is made from a plurality of hingedly interconnected strips can be moved like a louver thus fully clearing the opening of the case. Since the cover element is not swivelled and does not laterally project beyond the case, there is no danger that the case topples over. Since the cover element need not be raised, the space requirement is extremely small. Further, the louver-like movement of the cover element fully clears the opening of the case such that the contents is freely accessible from all sides of the case.

The cover element is preferably guided in lateral guides provided at the side wall elements.

At the front edge of the cover element one or a plurality of lock elements may be provided.

The cover part is adapted to be moved along the lateral guides into a position essentially parallel to the front wall elements thus assuming an open position. Since the cover element extends in parallel to the front wall element, the case can be opened without additional space being required.

The lateral guides are preferably made from a profile with a U-shaped cross-section.

The cover element may be provided with a handle.

The profile with a U-shaped cross-section may at least partially surround or border the side wall element. In the upper portion the lateral guides are arcuately bent by 90° such that the cover element can be moved from an essentially vertical open position into a horizontal closed position.

The linkage comprises two swivel arms and a coupling element, wherein each cover part is rigidly connected with one swivel arm and the coupling element hingedly connects the two swivel arms.

The swivel arms are swivellingly supported in the side wall elements in a vertical plane extending in parallel to the side wall elements.

The swivel arms may further be connected with each other via a spring element promoting the closing movement. Said spring element facilitates closing of the linkage-connected cover part during the one-hand closing operation.

The bottom, wall and cover elements may be made of plastic and/or metal, preferably aluminium.

BRIEF DESCRIPTION OF THE DRAWINGS

Hereunder embodiments of the invention will be explained in detail with reference to the drawings in which.

DETAILED DESCRIPTION OF THE PREFERRED EMBODIMENTS

Figure 1:
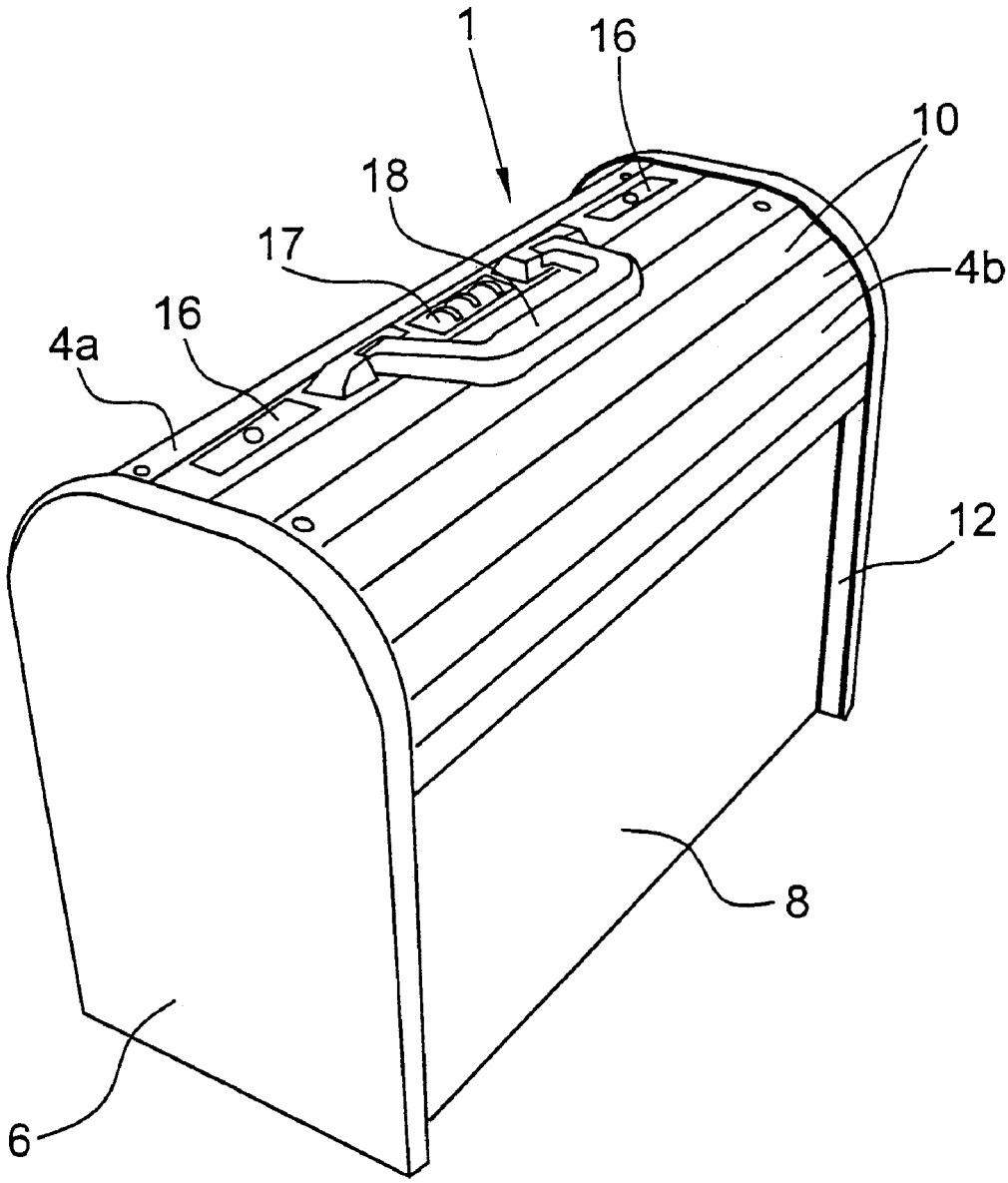
FIG. 1 shows a first embodiment of the case comprising a bipartite cover element.
Figure 2:
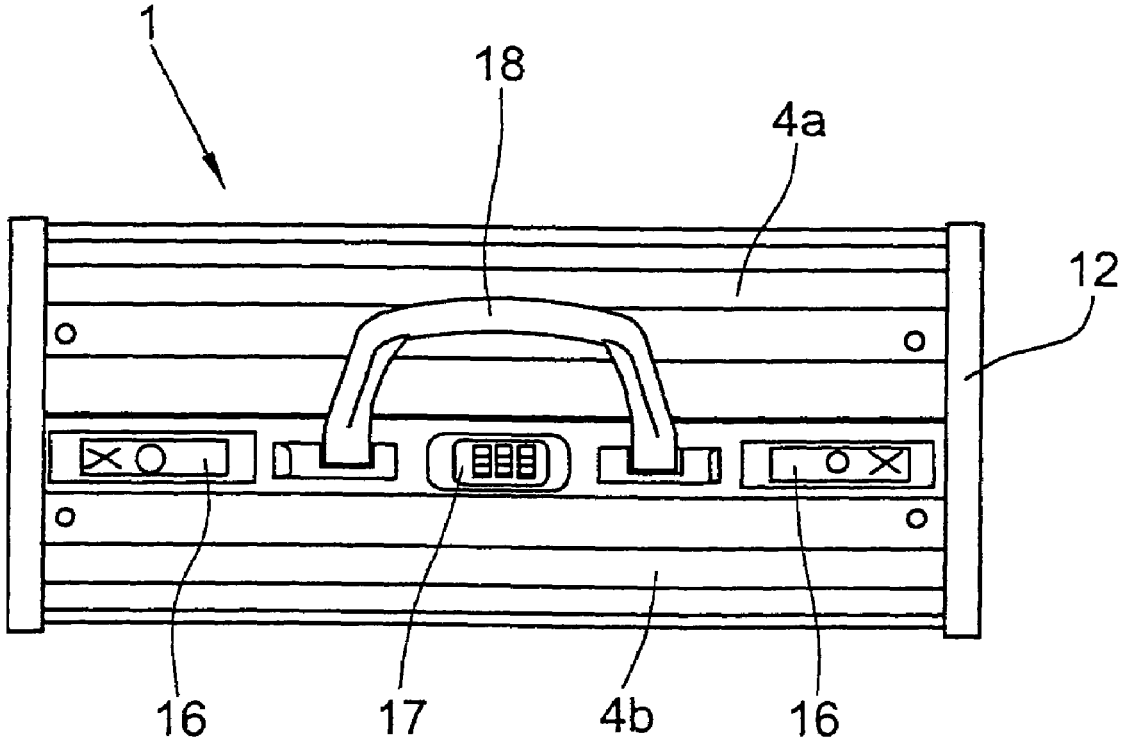
FIG. 2 shows a top view of the case shown in FIG. 1.

The cover parts 4*a*, 4*b* are formed by a plurality of strips 10 extending in parallel to each other and being hingedly connected with each other, which are guided like louvers in the lateral guides 12 such that at least a portion of the cover parts 4*a*, 4*b* is movable from a horizontal closed position on the upper side of the case into an essentially vertical position parallel to the front wall elements 8.

The free front edges 15 of the cover elements 4*a*, 4*b* comprise at least one lock element 16, 16*a*, 16*b*, 17 for locking the two cover parts 4*a*, 4*b* to each other in the closed position (FIG. 4) at a substantially bisecting plane P of curved portions (unnumbered) of the lateral guide 12. The numeral 17 designates a combination lock.

The lateral guides 12 are configured as frame elements and serve for receiving the side wall elements 6 and fastening the front wall elements 8.

Figure 3:
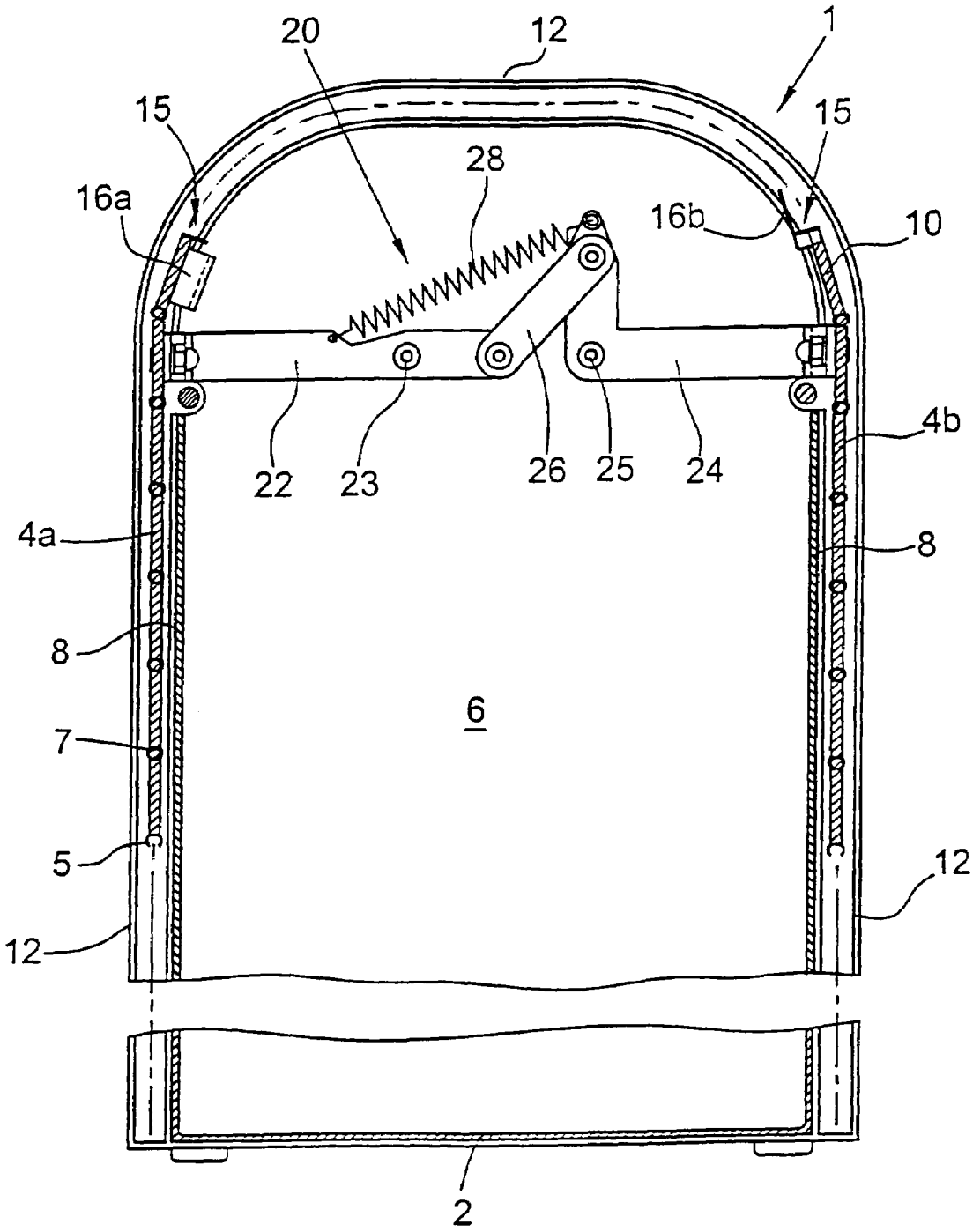

As can best be seen in FIG. 3, in the embodiment shown in FIG. 1 the lateral guides 12 completely surround the side wall elements 6.

As can best be seen in FIG. 3, the strips 10 extending in parallel to each other are hingedly connected with each other in that a coupling part 5 with a bell-shaped cross-section grips over a coupling part 7 with an essentially circular cross-section.

The two cover parts 4*a*, 4*b* are coupled with each other via a linkage 20 which comprises two swivel arms 22, 24 and a coupling element 26 hingedly connected with the two swivel arms 22, 24. The swivel arms 22, 24 are swivellingly supported via pivots 23, 25 in a vertical plane at the respective vertical side wall elements 6. The swivelling arm 22 is rigidly connected with the cover part 4*a*, and the swivel arm 24 is rigidly connected with the cover part 4*b*, wherein each swivel arm 22, 24 is fastened to one of the strips 10. When the cover part 4*b* comprising the handle 18 is moved, a corresponding force is transmitted via the coupling element 26 to the swivel arm 22 such that, synchronously with the movement of the cover part 4*b*, the cover part 4*a* is moved either. For this purpose, the two swivel arms 22, 24 are configured as two-arm levers. While the swivel arm 22 extends linearly, the swivel arm 24 is bent to form a right angle, wherein the hinge 25 is arranged at the location where the two legs of the swivel arm 24 intersect.

For promoting the closing movement, a spring element 28 configured as a tension spring and promoting the closing movement is arranged between the free end of the swivel arm 24 and the swivel arm 22. The spring element 28 is fastened to the swivel arm 22 in a central portion between the hinge 23 and the fastened end of the swivel arm 22.

Figure 4:
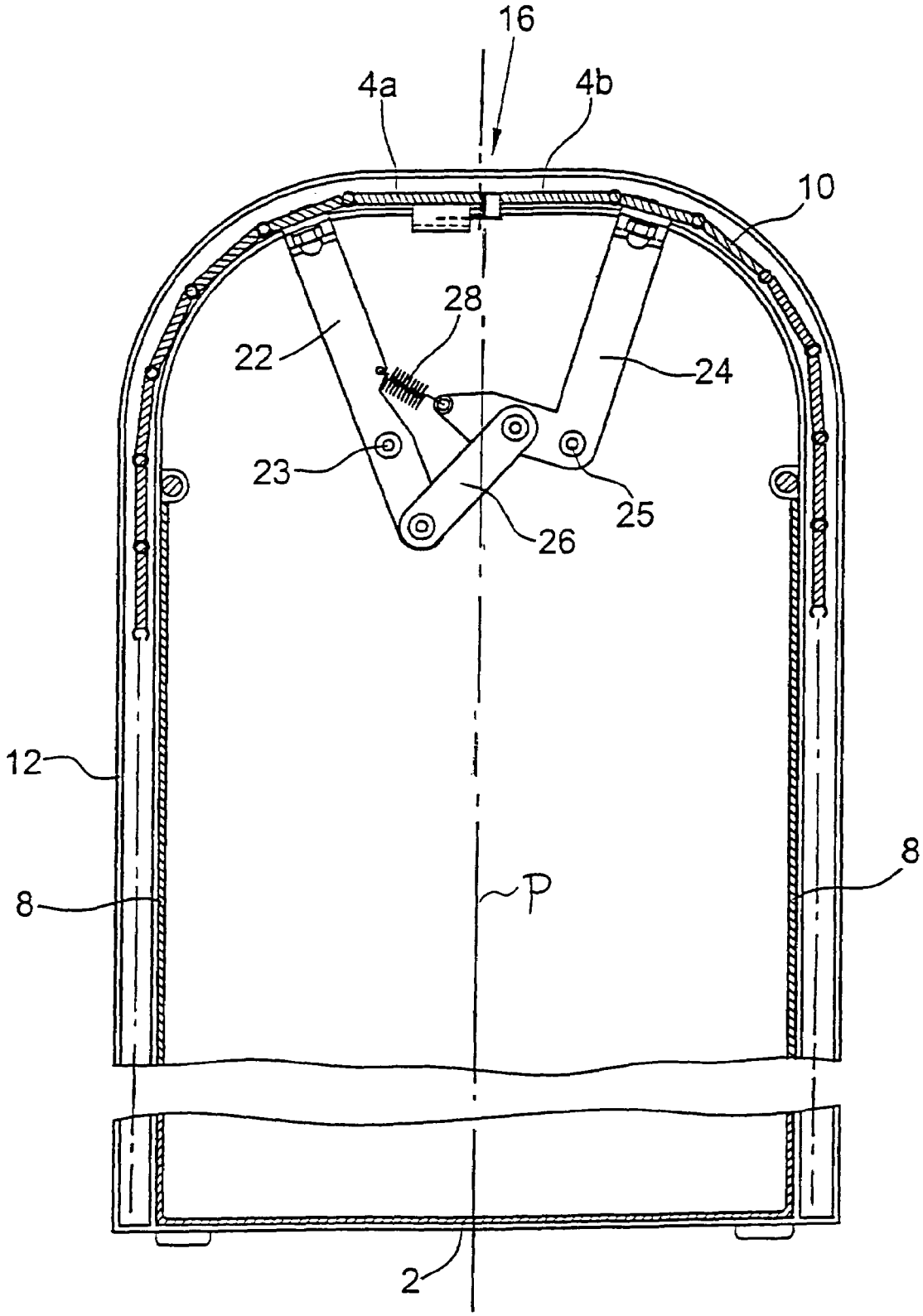

FIG. 4 shows the position of the linkage 20 in the closed position of the cover parts 4*a*,4*b*.

Figure 5:
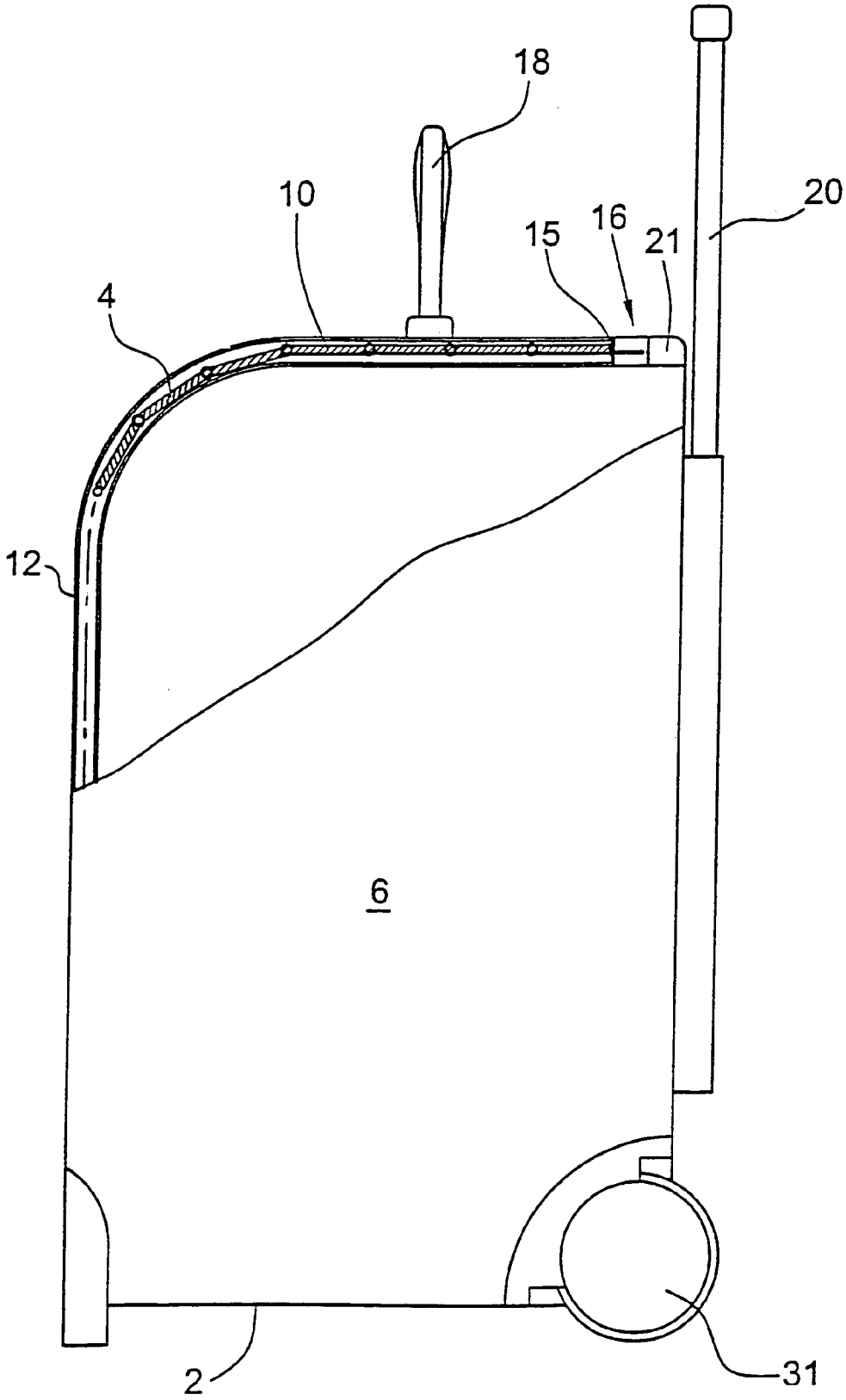

FIG. 5 shows a further embodiment of a case of the trolley case type. This case comprises only one cover part 4 which can also be guided like a louver in a lateral guide 12 such that it performs a 90° turn. The rear edge of the cover element 4 can be moved down to the bottom 2 of the case such that a wide opening is formed. This case can be provided with a trolley handle 20 and two rollers 31.

In all embodiments the width of the strips 10 amounts to approximately 15 to 25 mm, preferably 23 mm. With such a strip width curvature radii of the lateral guides can be realized which do not substantially restrict the case volume.

Figure 6:
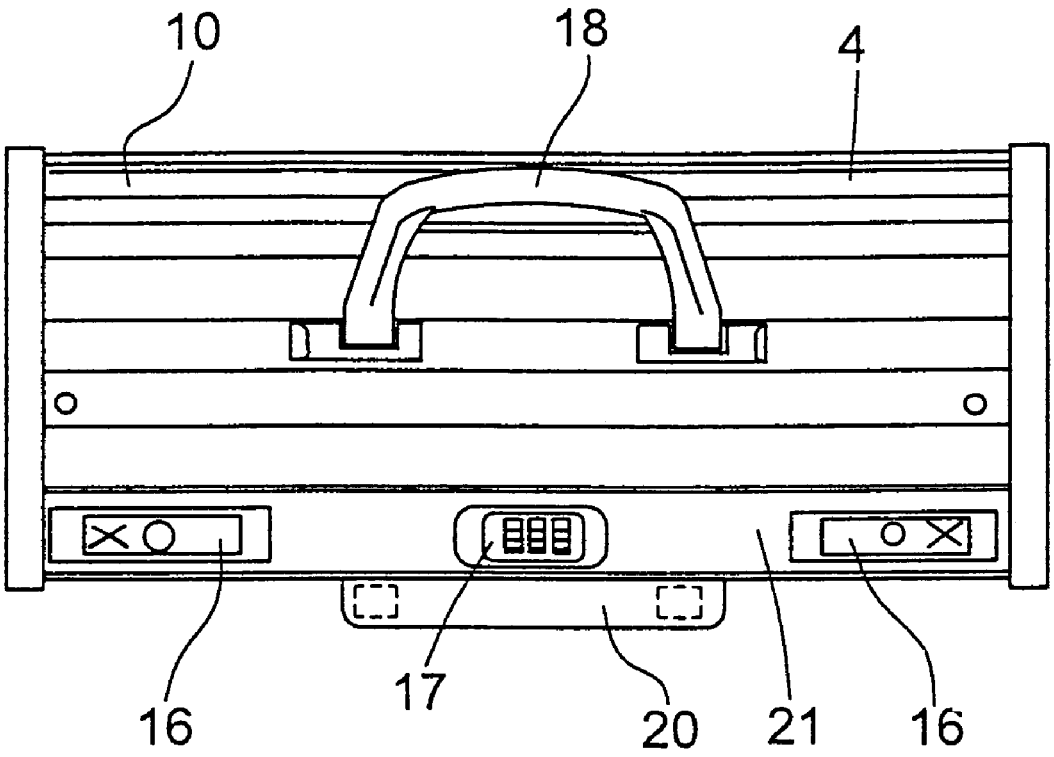

In the embodiment shown in FIGS. 5 and 6 a horizontal batten 21 can receive the lock elements 16 and 17 which cooperate with corresponding lock elements at the front edge 15 of the cover element 4.

Although a preferred embodiment of the invention has been specifically illustrated and described herein, it is to be understood that minor variations may be made in the apparatus without departing from the spirit and scope of the invention, as defined by the appended claims.

What is claimed is:

1. A case particularly adapted for use as a pilot case comprising a case body defined by a bottom wall, a pair of opposite relatively spaced side walls and a pair of opposite relatively spaced front walls; said case body including an opening opposite said bottom wall, a cover for opening and closing said opening, said cover being defined by a pair of cover elements, each pair of cover elements being formed by a plurality of hingedly interconnected strips, a terminal edge of a terminal strip of each pair of cover elements being in contiguous relationship to each other in a first position of said pair of cover elements closing said opening and being in spaced relationship to each other in a second position of said pair of cover elements opening said opening, lateral guide means in opposing relationship to each other along one of said pair of opposite side and front walls for guiding the movement of said pair of cover elements between said first and second positions, linkage means connected to each other and to said pair of cover elements for substantially synchronous simultaneous movement thereof during movement of only one of the cover elements between said first and second positions whereby a remaining one of the cover elements is moved absent direct manual manipulation, and said each cover element having bottom terminal end, said terminal end position within the guide means on the two front walls in both closing and opening positions.

2. The case as defined in claim 1 wherein said lateral guide means are disposed along said opposite side walls.

3. The case as defined in claim 1 including means for locking said pair of cover elements in the first closed position thereof.

4. The case as defined in claim 1 including means for locking said terminal strips to each other in the first closing position of said pair of cover elements.

5. The case as defined in claim 1 wherein said pair of cover elements and one of said pair of side walls and front walls are in substantially parallel relationship to each other in said second open position.

6. The case as defined in claim 1 wherein said pair of cover elements and said pair of front walls are in substantially parallel relationship to each other in said second open position.

7. The case as defined in claim 1 wherein said pair of cover elements and one of said pair of side walls and front walls are in substantially parallel relationship to each other in said second open position, and the other of said pair of side walls and front walls are in substantially normal relationship to said pair of cover elements in said second open position.

8. The case as defined in claim 1 wherein said pair of cover elements and said pair of front walls are in substantially parallel relationship to each other in said second open position, and said pair of side walls are in substantially normal relationship to said pair of cover elements in said open position thereof.

9. The case as defined in claim 1 including handle means for carrying said case body.

10. The case as defined in claim 1 wherein said lateral guide means are substantially U-shaped in transverse cross-section.

11. The case as defined in claim 1 wherein said lateral guide means are substantially U-shaped in transverse cross-section, and open toward each other.

12. The case as defined in claim 1 wherein said lateral guide means are substantially U-shaped in transverse cross-section, and opposite end edge portions of said plurality of hingedly interconnected strips are located in and slide relative to said U-shaped lateral guide means between said first and second positions.

13. The case as defined in claim 1 wherein said lateral guide means are defined by a pair of guide members disposed in spaced relationship to each other, said guide members being each of an inverted substantially U-shaped configuration defined by a pair of substantially parallel guide member leg portions spanned at said opening by an outwardly convex guide member portion, and said terminal strip terminal edges are in contiguous relationship along a substantially bisecting plane of said outwardly convex guide member portion.

14. The case as defined in claim 1 wherein said linkage means includes a pair of swivel arms and a coupling element pivotally connected there between, and said swivel arms are substantially rigidly connected one to each of said pair of cover elements.

15. The case as defined in claim 1 wherein said linkage means includes a pair of swivel arms and a coupling element pivotally connected there between, said swivel arms are substantially rigidly connected one to each of said pair of cover elements, and means for pivotally connecting said pair of swivel arms to one of said side and front walls.

16. The case as defined in claim 1 wherein said linkage means includes a pair of swivel arms and a coupling element pivotally connected there between, said swivel arms are substantially rigidly connected one to each of said pair of cover elements, means for pivotally connecting said pair of swivel arms to one of said side and front walls, and means biasing said swivel arms relative to each other in a relative direction to effect movement of said pair of cover elements toward the closed position thereof.

17. The case as defined in claim 5 wherein said lateral guide means are defined by a pair of guide members disposed in spaced relationship to each other, said guide members being each of an inverted substantially U-shaped configuration defined by a pair of substantially parallel guide member leg portions spanned at said opening by an outwardly convex guide member portion, and said terminal strip terminal edges are in contiguous relationship along a substantially bisecting plane of said outwardly convex guide member portion.

18. The case as defined in claim 13 wherein said lateral guide means are substantially U-shaped in transverse cross-section.

19. The case as defined in claim 13 wherein said linkage means includes a pair of swivel arms and a coupling element pivotally connected therebetween, and said swivel arms are substantially rigidly connected one to each of said pair of cover elements.

20. The case as defined in claim 13 wherein said linkage means includes a pair of swivel arms and a coupling element pivotally connected therebetween, said swivel arms are substantially rigidly connected one to each of said pair of cover elements, and means for pivotally connecting said pair of swivel arms to one of said side and front walls.

21. The case as defined in claim 13 wherein said linkage means includes a pair of swivel arms and a coupling element pivotally connected therebetween, said swivel arms are substantially rigidly connected one to each of said pair of cover elements, means for pivotally connecting said pair of swivel arms to one of said side and front walls, and means biasing said swivel arms relative to each other in a relative direction to effect movement of said pair of cover elements toward the closed position thereof.

22. The case as defined in claim 15 wherein said lateral guide means are substantially U-shaped in transverse cross-section.

23. The case as defined in claim 1 wherein said linkage means includes a pair of swivel arms and a coupling element pivotally connected to each of said swivel arms.

24. The case as defined in claim 23 including means for pivotally connecting each swivel arm to one of said side and front walls.

25. The case as defined in claim 1 including a handle associated with said only one cover element to effect manual movement thereof.

26. The case as defined in claim 23 including a handle associated with said only one cover element to effect manual movement thereof.

27. The case as defined in claim 24 including a handle associated with said only one cover element to effect manual movement thereof.

* * * * *